US007005800B2

(12) United States Patent
Marchand

(10) Patent No.: US 7,005,800 B2
(45) Date of Patent: Feb. 28, 2006

(54) LAMP WITH ANTI-EXPLOSION DEVICE

(75) Inventor: Jacky Paul Marchand, Maidieres (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/222,244

(22) Filed: Aug. 16, 2002

(65) Prior Publication Data

US 2003/0062834 A1 Apr. 3, 2003

(30) Foreign Application Priority Data

Aug. 21, 2001 (FR) ..... 01 10959

(51) Int. Cl.
*H01K 1/50* (2006.01)

(52) U.S. Cl. ..... 313/580; 313/579; 313/269

(58) Field of Classification Search ..... 313/269–271, 313/579–580, 279, 273
See application file for complete search history.

(56) References Cited

U.S. PATENT DOCUMENTS 2,877,375 A * 3/1959 Pearson ..... 313/315
3,007,073 A * 10/1961 Swasey et al. ..... 313/277
3,403,280 A 9/1968 Cardwell, Jr.
3,840,953 A 10/1974 Martin
3,930,177 A * 12/1975 Martin ..... 313/271
4,132,922 A * 1/1979 Newton et al. ..... 315/73
4,613,787 A * 9/1986 Swain ..... 313/579
4,801,845 A * 1/1989 Kiesel ..... 313/579
4,835,443 A * 5/1989 Benson et al. ..... 313/579
4,876,482 A * 10/1989 Stadler ..... 313/579
4,994,707 A * 2/1991 Stark ..... 313/269
5,093,601 A * 3/1992 Watanabe et al. ..... 313/25
5,404,069 A * 4/1995 Olwert et al. ..... 313/279
6,239,550 B1 * 5/2001 Maeda ..... 313/579
6,717,339 B1 * 4/2004 Marchand ..... 313/271

OTHER PUBLICATIONS

Patent Abstracts of Japan; vol. 1998, No. 14, Dec. 31, 1998, JP10241639.

* cited by examiner

*Primary Examiner*—Joseph Williams
*Assistant Examiner*—Dalei Dong

(57) ABSTRACT

An incandescent electric lamp includes a bulb, current-conductor wires, a filament having turns arranged in spiraling fashion around an axis of revolution, one end of the filament being connected to a conductor wire, a metal support connected to the other conductor wire and to the other end of the filament, and a metal bracket which is in electrical contact with one of the ends or one of the turns of the filament and which comprises a portion parallel to the axis of revolution of the filament and situated below the filament when the lamp is in its normal operating position. The metal bracket is, for example, at the potential of the end. At the end of lamp life, the filament sags and comes into contact with the metal bracket, thus causing a short-circuit and a breaking of the filament, which prevents an explosion of the lamp.

4 Claims, 4 Drawing Sheets

LAMP WITH ANTI-EXPLOSION DEVICE

FIELD OF THE INVENTION

The invention relates to an incandescent electric lamp comprising a bulb having an axis of revolution, a first and a second conductor wire designed for supplying said lamp with current, a filament having turns spiraling around an axis of revolution which is parallel to the axis of revolution of said bulb and having a first and a second end, the first end of said filament being connected to the first conductor wire by means of a first metal plate, and a metal support having a first and a second end, the first end of said metal support being connected to the second conductor wire by means of a second metal plate, while the second end of said metal support is connected to the second end of said filament.

Such a lamp is used, for example, in a heating system designed for use in the manufacture of semiconductor components.

STATE OF THE ART

Such a lamp is described in U.S. Pat. No. 3,403,280 published Sep. 24 1968. One of the objects of the invention as disclosed in this document is to ensure a filament position such that the axis of rotation of the turns of the filament substantially coincides with the axis of rotation of the bulb. During normal operational conditions of the lamp, the axis of rotation of the turns of the filament is usually horizontal, i.e. perpendicular to a weight vector of the filament. Such a lamp, however, is often used for dissipating a high power, for example several thousands of watts. Under such conditions the filament reaches a comparatively high temperature when being traversed by a current. The filament will have a tendency to be mechanically deformed under the influence of the high temperature and its own weight, thus developing a curvature in downward direction, i.e. the turns of the filament sag, which sagging of a turn will be greater in proportion as the turn is situated closer to a central zone of the filament. In addition, this sagging becomes more pronounced as the filament has had a longer period of operation. When the lamp has been operating during a comparatively long period, therefore, the sagging may be such that the filament comes into contact with the bulb, which may give rise to a crack or an explosion of the bulb, because the temperature of the filament is higher than the softening point of the bulb, which is usually made of quartz. Now such lamps may be used, for example, in the manufacture of semiconductors. An explosion is accordingly detrimental because quartz fragments can pollute the semiconductors.

BRIEF DESCRIPTION OF THE INVENTION

It is an object of the invention to provide an anti-explosion device for an incandescent lamp.

According to the invention, an incandescent lamp as defined in the opening paragraph is characterized in that it comprises a metal bracket which is in electrical contact with one of the ends or one of the turns of said filament and which comprises a substantially rectilinear portion parallel to the axis of revolution of said filament and situated below said filament when the lamp is in its normal operating position.

If the filament sags considerably, one of the turns situated in a central zone of the filament will come into contact with the metal bracket before touching the bulb. Owing to this, approximately one half of the filament will become short-circuited. This leads to a reduction in resistance of the filament, accordingly an increase in the current strength in the filament and finally an increase in the filament temperature. The filament then reaches a temperature higher than its melting point and will be broken. The lamp will no longer function after this and cannot explode, because the filament cannot reach the bulb while the lamp is operating.

In a first particular embodiment of the invention, the lamp is characterized in that said metal bracket is connected to the first metal plate. In this embodiment, the metal bracket may be a simple straight rod welded to the metal plate, which renders such a metal bracket particularly simple to manufacture and to install in the lamp.

In a second particular embodiment of the invention, the lamp is characterized in that said metal bracket is connected to the metal support. In this embodiment, the metal support itself may play the part of the metal bracket responsible for the short-circuit which leads to a breaking of the filament. The number of components necessary for manufacturing the lamp is reduced thereby.

In a modification of the invention, the lamp is characterized in that it comprises in addition at least one intermediate support hooked to a turn of said filament. The intermediate support(s) hooked to the filament render(s) it possible to reduce the sagging of the latter and thus to postpone the moment of contact between the filament and the metal bracket, which prolongs the period during which the lamp can function.

In a first particular embodiment of this modification, the lamp is characterized in that the intermediate support(s) is (are) situated above the filament when the lamp is in its normal operating position. Such an embodiment safeguards that the filament is well retained, because the mechanical deformation suffered by the filament takes place in downward direction. Moreover, the risk of contact involving an intermediate support and two turns is eliminated, which is advantageous because such a contact would lead to an undesired short-circuit which would be fatal for the lamp.

In a second particular embodiment of this modification, the lamp is characterized in that said metal bracket is connected to one of the at least one intermediate support. In this embodiment, one of the intermediate supports itself may play the part of metal bracket, which reduces the number of components necessary for manufacturing such a lamp.

BRIEF DESCRIPTION OF THE FIGURES

The invention will be better appreciated and further details will become apparent from the following description which is given with reference to the annexed drawings, which represent examples to which the invention is not limited and in which:

FIGS. 1*a* and 1*b* are a front elevation and a cross-section, respectively, of a lamp in a first particular embodiment of the invention, while

FIGS. 2*a* and 2*b* are a front elevation and a cross-section, respectively, of a lamp in a second particular embodiment of the invention, while

DETAILED DESCRIPTION OF AT LEAST ONE EMBODIMENT OF THE INVENTION

Figure 1B:
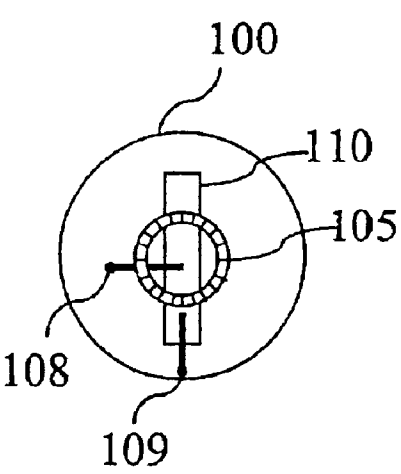
Figure 1A:
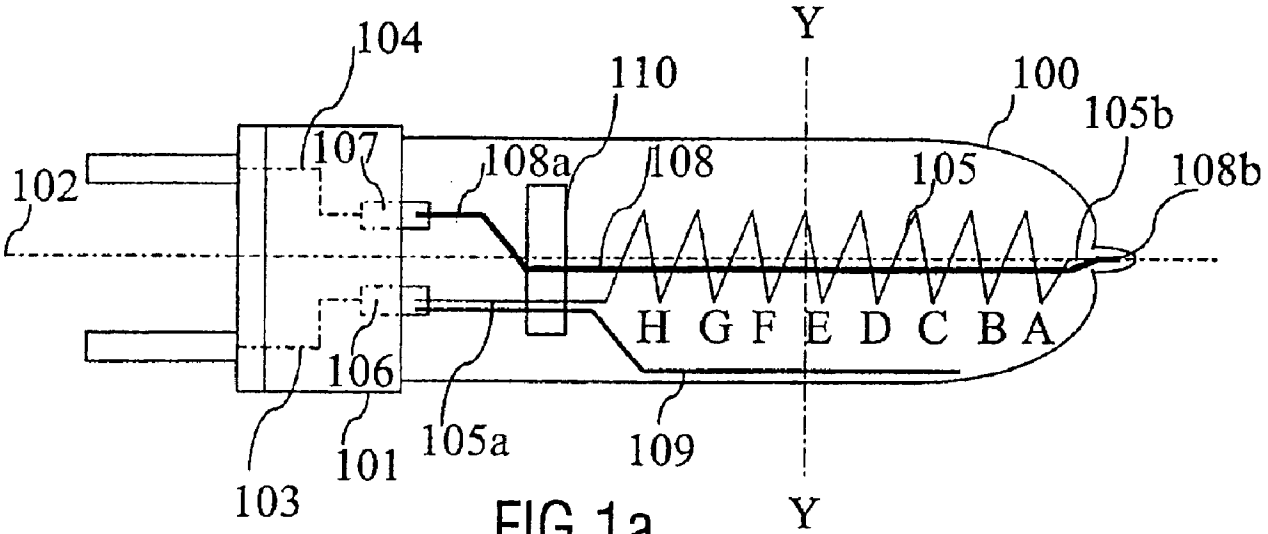

FIG. 1*a* shows a lamp in a first particular embodiment of the invention. Such a lamp comprises a bulb 100 having an axis of revolution 102, a first conductor wire 103, a second conductor wire 104, a filament 105 having a first end 105*a* and a second end 105*b*, a first metal plate 106, a second metal plate 107, a metal support 108 having a first end 108*a* and a second end 108*b*, and a metal bracket 109. The filament 105 has eight turns A to H. Such a lamp may also comprise a pinch seal 101 as well as a bridge 110 of insulating material capable of keeping in place certain elements of the lamp such as the filament 105, the metal support 108, and the metal bracket 109.

The first end 105*a* of the filament 105 is connected to the first conductor wire 103 by means of the first metal plate 106. The metal plates 106 and 107 are means for interconnecting elements electrically, such as the first conductor wire 103 and the filament 105. Said metal plates 106 and 107 may be metal plates on which the elements are welded. They may equally well be weld spots, i.e. the elements to be electrically interconnected are directly welded one onto the other.

The second end 105*b* of the filament 105 is connected to the second end 108*b* of the metal support 108, and the first end 108*a* of the metal support 108 is connected to the second conductor wire 104 by means of the second metal plate 107. The filament 105 and the metal support 108 thus form a current circuit. The current enters by the second conductor wire 104, traverses the metal support 108 and then, in that order, the turns A, B, C, D, E, F, G, and H, and leaves by the second conductor wire 103. When traversing the filament 105, the current heats this filament owing to the Joule effect, which filament thus becomes a light source. The metal bracket 109 is welded onto the first metal plate 106 and is accordingly in electrical contact with the first end 105*a* of the filament 105, which is also welded to this plate. The expression "an object A and an object B are in electrical contact" is in fact understood to mean that the object A and the object B are at one and the same potential.

FIG. 1*b* shows a cross-section of the lamp of FIG. 1*a* taken on the line YY. The metal support 108 is located outside a plane defined by the axis of revolution 102 and the metal bracket 109 so as to avoid all contact between the turns of the filament 105 and the metal support 108 should the filament 105 sag.

Figure 1C:
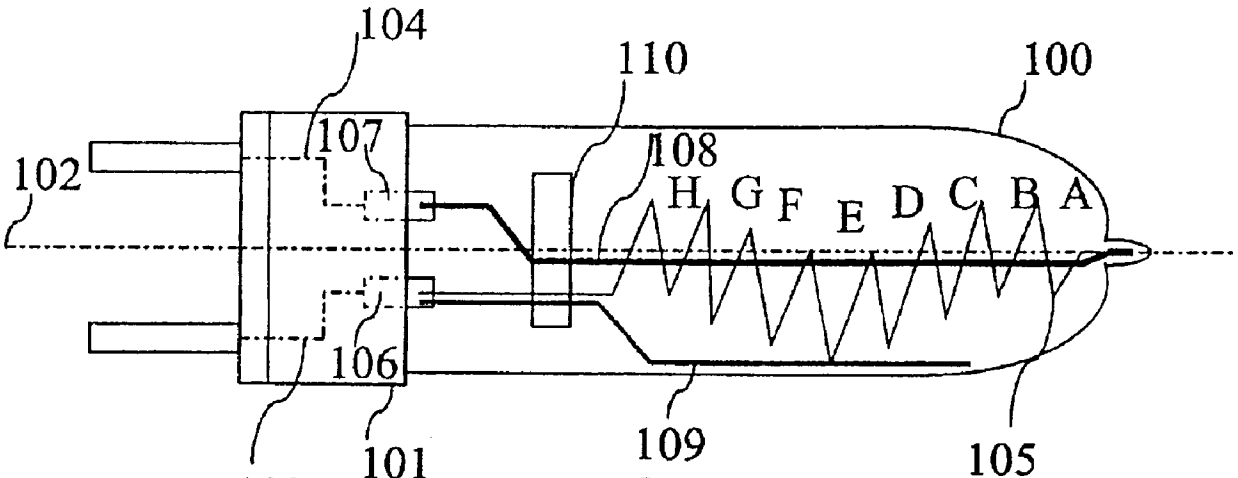
FIG. 1*c* illustrates a short-circuit in this lamp.

FIG. 1*c* makes apparent the role of the metal bracket 109. When the filament 105 sags, one of the turns, for example turn E, will come into contact with the metal bracket 109. In such a situation, the current will enter by the second conductor wire 104, traverse the metal support 108 and then, in that order, the turns A, B, C, D, and will subsequently follow a path of least resistance, i.e. the metal bracket 109, finally leaving by the first conductor wire 103. The turns E, F, G, and H have thus been short-circuited. This leads to an increase in the current strength in the turns A, B, C, and D, which causes such an intense heating that the filament 105 is broken.

Figure 2B:
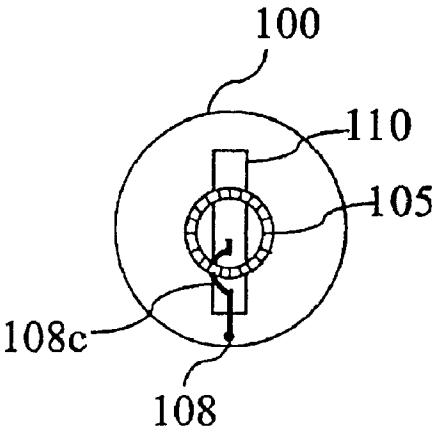
Figure 2A:
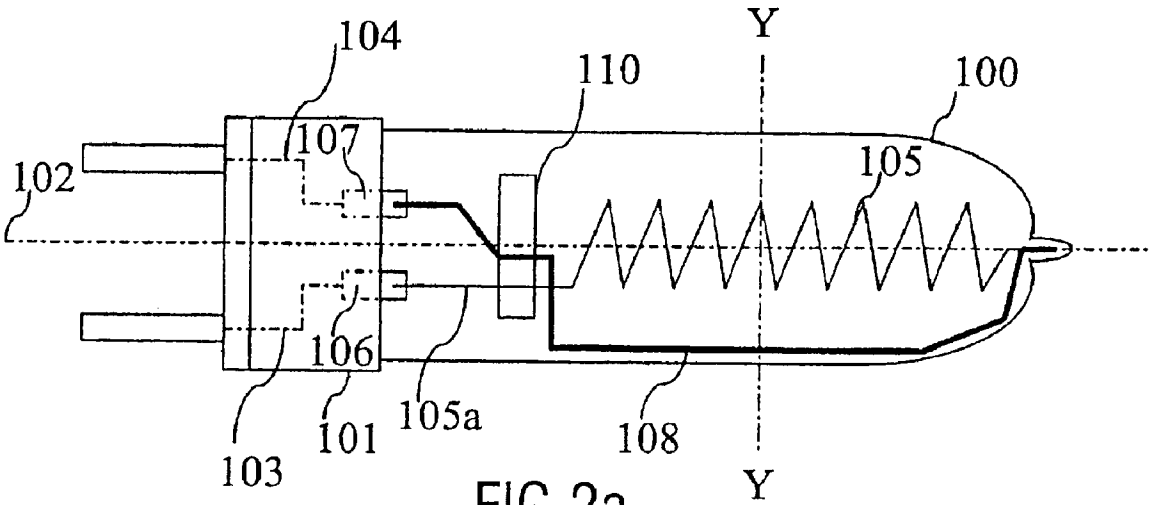
Figure 2C:
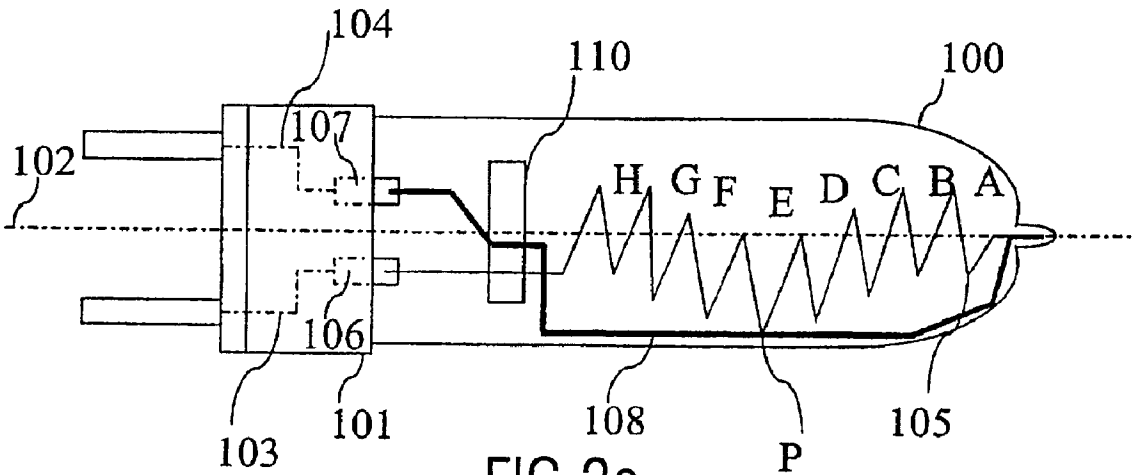
FIG. 2*c* illustrates a short-circuit in this lamp.

FIG. 2*a* shows a lamp in a second particular embodiment of the invention. In this embodiment, the metal bracket is connected to the metal support 108. The term "connected" is understood to mean that the metal bracket may be a metal piece welded or attached to the metal support 108, or alternatively that the metal bracket may be an integral part of the metal support, i.e. the metal support 108 itself performs the function of the metal bracket 109. The metal support 108 thus has a straight portion in FIG. 2*a* situated below the filament 105. It thus performs the function of the metal bracket 109 of FIG. 1*a*. To achieve that the metal support 108 will not come into contact with the first end 105*a* of the filament 105, which would render the lamp inoperative, the metal support 108 has a hook 108*c* as shown in FIG. 2*b*, which is a cross-sectional view taken on the line YY. FIG. 2*c* makes clear how such a metal support 108 performs the function of a metal bracket responsible for the short-circuit leading to a breaking of the filament. When one of the turns, for example the turn E, comes into contact with the metal support 108 in a contact point P, as shown in FIG. 2*c*, the current will enter by the second conductor wire 104, pass through the metal support 108 up to the contact point P, then traverse the turns E, F, G, and H, and leaves again by the first conductor wire 103. The turns A, B, C, and D are short-circuited thereby, and the filament will be broken for the same reasons as described with reference to FIG. 1*c*.

In a modification of the invention, the lamp comprises in addition at least one intermediate support hooked to a turn of said filament.

Figure 3B:
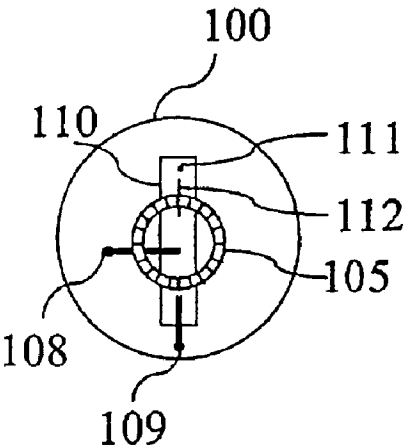
FIGS. 3*a* and 3*b* are a front elevation and a cross-section, respectively, of a lamp in a first particular embodiment of a modification of the invention.
Figure 3A:
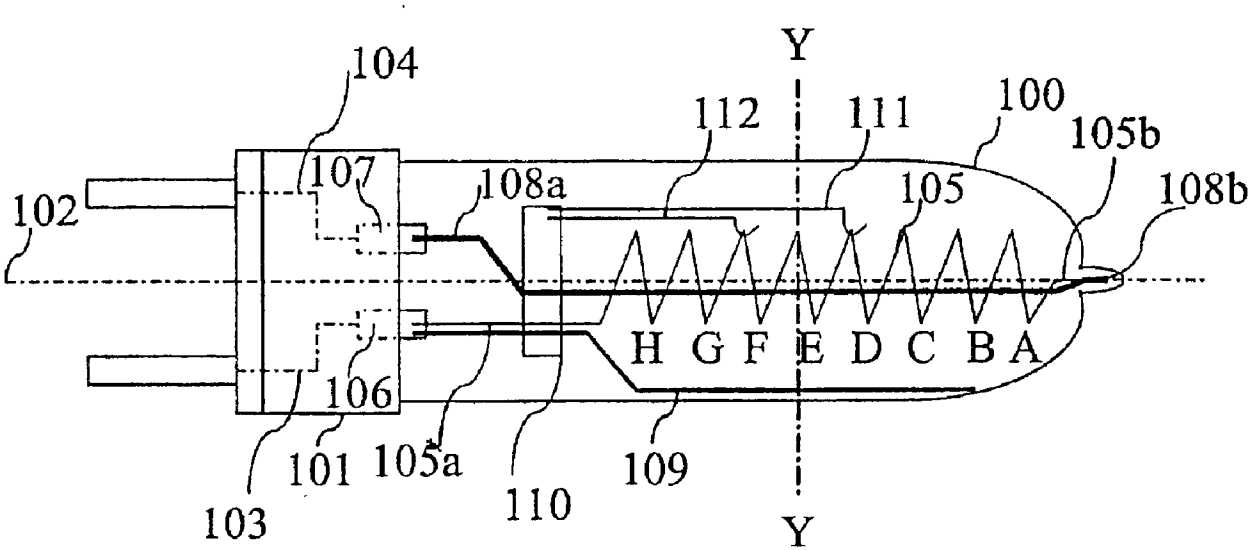

FIG. 3*a* shows a lamp in a first particular embodiment of this modification, and FIG. 3*b* is a cross-sectional view of such a lamp taken on the line YY. Such a lamp comprises in addition to the elements described above with reference to FIG. 1*a* a first intermediate support 111 and a second intermediate support 112, situated above the filament 105. These two intermediate supports ensure a good retention of the filament 105 and counteract its sagging. As a result of this, the breaking of the filament 105 caused by the metal bracket 109 will arrive at the end of a period of operation of the lamp which is longer than if such intermediate supports were absent. The intermediate supports 111 and 112 may be fused into the bridge 110 or in the pinch seal 101. They may each have a hooked end, as shown in FIG. 3*a*, which renders their mounting in the lamp particularly simple.

Figure 4B:
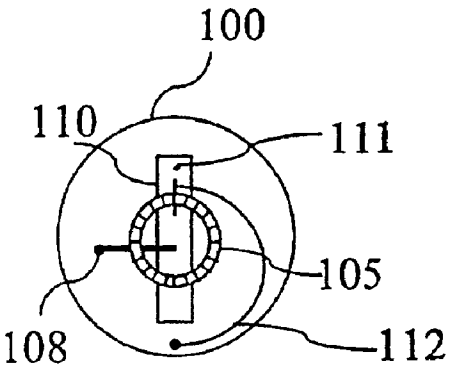
FIGS. 4*a* and 4*b* are a front elevation and a side elevation, respectively, of a lamp in a second particular embodiment of a modification of the invention, with FIG. 4*c* illustrating a short-circuit in this lamp.
Figure 4A:
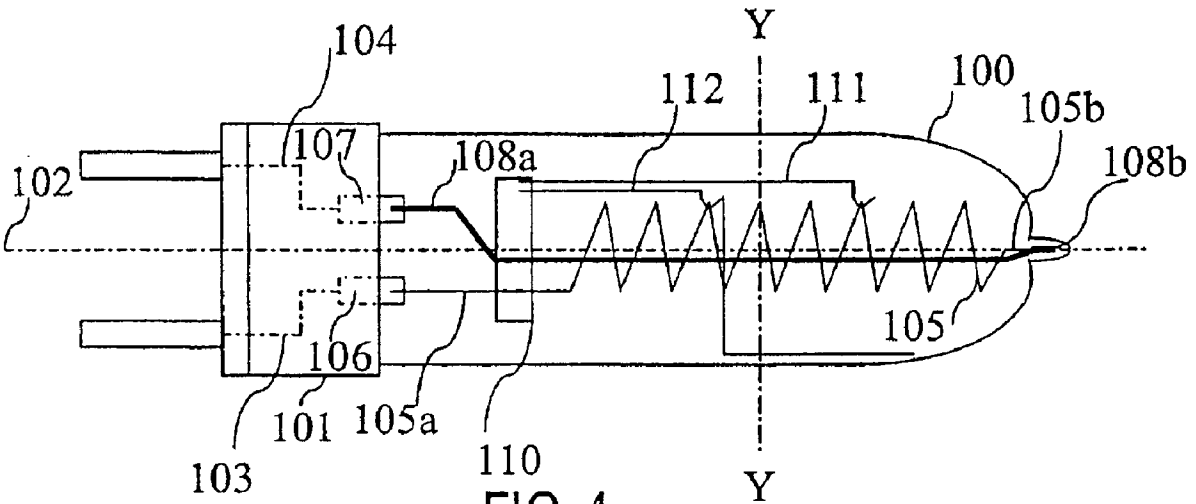

FIG. 4*a* illustrates a lamp in a second particular embodiment of this modification, FIG. 4*b* being a cross-sectional view of such a lamp taken on the line YY. In this embodiment, the metal bracket is connected to one of the intermediate supports. The term "connected" is understood to mean that the metal bracket may be a metal piece welded or attached to an intermediate support, or that the metal bracket may form an integral part of an intermediate support, i.e. that an intermediate support itself performs the function of the metal bracket 109. The second intermediate support 112 is thus prolonged by a metal part in FIG. 4*a*, comprising a straight portion situated below the filament 105. It accordingly performs the function of the metal bracket 109 of FIG. 1*a*. Obviously, the first intermediate support 111 might equally well perform this function. The second intermediate support 112 curves around the filament 105, as is visible in FIG. 4*b*, so that it will not come into contact with the filament 105 in a point other than at the level of its hook unless the filament 105 sags.

Figure 4C:
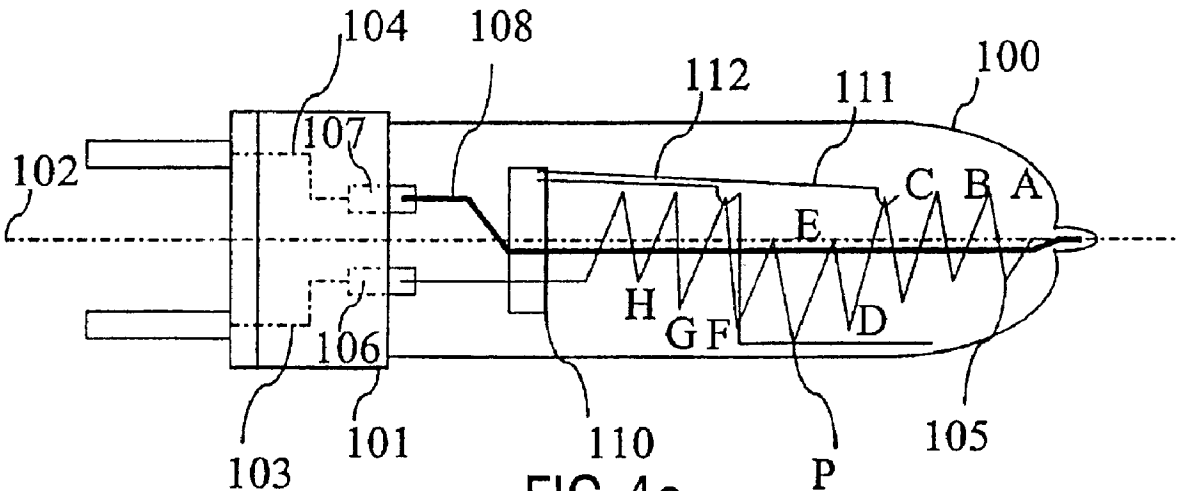

FIG. 4*c* makes clear how such an intermediate support 112 performs the function of a metal bracket responsible for the short-circuit which leads to a filament breaking. When one of the turns, for example the turn E, comes into contact with the intermediate support 112 in a contact point P, the current will enter by the second conductor wire 104, pass through the metal support 108, then through the turns A, B, C, D, and E, up to the point of contact P, then through the second intermediate support 112 up to its hook, and finally the turns G and H, so as to leave by the first conductor wire 103. The turn F and part of the turn E are short-circuited thereby and, for the same reasons as given in the description of FIG. 1*c*, the filament 105 can be broken. It is to be noted that in such a case the heating caused by the short-circuit is less strong than in the case in which the metal bracket 109 is used, for example in the lamp of FIG. 1*a*. In fact, a smaller number of turns is short-circuited in the case of FIG. 4*c*. Nevertheless, this heating may be sufficient for provoking the breaking of the filament 105.

The above description with reference to the Figures illustrates the invention without in any way limiting it. A few remarks will be made below to this effect. FIGS. 1*a* to 4*c* illustrate examples of embodiments of the invention. It is to be understood that the invention is not limited to these few examples. Other types of metal brackets may be conceived as long as these brackets are capable of causing a short-circuit of certain turns of the filament 105 so as to avoid an explosion of the lamp at the end of its life. Similarly, a metal bracket may be connected to the filament 105 in locations other than those described in the Figures. In FIG. 1*a*, for example, the metal bracket 109 may be directly welded or attached to the first end 105 of the filament 105 instead of being welded to the first metal plate 106. It may equally well be welded or attached to one of the turns of the filament 105, for example the turn H.

What is claimed is:

1. An incandescent electric lamp comprising:

a bulb having a longitudinal axis;

a first and a second conductor wire;

a filament having turns around an axis parallel to the longitudinal axis and having a first and a second end, the first end of the filament being connected to the first conductor wire;

a metal support having a first and a second end, the first end of the metal support being connected to the second conductor wire, the second end of the metal support being connected to the second end of the filament;

an intermediate support comprising a first length above the filament when the lamp is in a normal operating position, a hook connected to a turn of the filament, and a second length of the intermediate support extending from above to below the filament when the lamp is in a normal operating position; and a metal bracket supported by the second length of the intermediate support which is located directly opposite at least a portion of the filament and is also situated below the filament when the lamp is in the normal operating position.

2. An incandescent electric lamp, comprising:

a bulb having an axis of revolution;

a first and a second conductor wire designed for supplying said lamp with current;

a filament having turns spiraling around an axis of revolution which is parallel to the axis of revolution of said bulb and having a first and a second end, the first end of said filament being connected to the first conductor wire by a first metal plate; and a metal support having a first and a second end, the first end of said metal support being connected to the second conductor wire by a second metal plate, the second end of said metal support being connected to the second end of said filament, a metal bracket connected, during operation of the lamp, through a current conductor to the first or second conductor wire, the metal bracket having an unsecured end and a portion parallel to the axis of revolution of said filament, the portion being located directly opposite at least a portion of the filament and also situated below said filament when the lamp is in its normal operating position, at least one intermediate support hooked to a turn of said filament, said metal bracket being connected to one of the at least one intermediate support.

3. An incandescent electric lamp comprising:

a bulb;

a filament extending along a length of the bulb, the filament comprising a material the melting point of which is below a temperature generated when the filament is short-circuited; and a metal bracket connected during operation of the lamp to means for conducting current, the metal bracket being positioned between the filament and the bulb at a point at which a change in position of a portion of the filament causes the filament to contact the metal bracket, the metal bracket being located directly opposite at least a portion of said filament and also being situated below said filament when the lamp is in its normal operating position, at least one intermediate support hooked to a turn of said filament, said metal bracket being connected to one of the at least one intermediate support.

4. An incandescent electric lamp comprising:

a bulb having an axis of revolution and surrounding a space;

a first and a second conductor wire designed for supplying said lamp with current;

a filament having turns spiraling around an axis of revolution which is parallel to the axis of revolution of said bulb and having a first and a second end, the first end of said filament being connected to the first conductor wire by a first metal plate, the metal platee being at least partly disposed in the space; and a metal support having a first and a second end, the first end of said metal support being connected to the second conductor wire by a second metal plate, while the second end of said metal support is connected to the second end of said filament, wherein the lamp comprises a metal bracket which, during operation of the lamp is connected through a current conductor to the first or second conductor wire, has an unsecured end and comprises a portion parallel to the axis of revolution of said filament which is located directly opposite at least a portion of the filament and is also situated below said filament when the lamp is in its normal operating position.

* * * * *